United States Patent [19]

Kiele

[11] 3,951,613

[45] Apr. 20, 1976

[54] ANTI-POLLUTION HEATING OIL PRODUCTS AND PROCESSES

[75] Inventor: Francis S. Kiele, Yonkers, N.Y.

[73] Assignee: Stewart Hall Chemical Co., Mount Vernon, N.Y.

[22] Filed: Dec. 11, 1973

[21] Appl. No.: 423,719

Related U.S. Application Data

[62] Division of Ser. No. 112,461, Feb. 3, 1971, abandoned.

[52] U.S. Cl. ..... 44/5; 44/57

[51] Int. Cl.[2] ..... C10L 9/00; C10L 1/08

[58] Field of Search ..... 44/57, 66, 68, 68 V, 44/70, 4, 5, 6

[56] References Cited

UNITED STATES PATENTS

| | | | |
|---|---|---|---|
| 933,875 | 9/1909 | Boggs | 44/5 |
| 2,845,338 | 7/1958 | Ryznar et al. | 44/5 |
| 3,272,607 | 9/1966 | Case | 44/70 |
| 3,348,932 | 10/1967 | Kukin | 44/4 |
| 3,437,465 | 4/1969 | LeSuer | 44/51 |

*Primary Examiner*—Carl F. Dees
*Attorney, Agent, or Firm*—Darby & Darby

[57] ABSTRACT

An anti-pollution heating oil composition includes an organic or inorganic lithium compound in said heating oil to reduce particulate emission upon combustion of said heating oil. A variety of lithium compositions and processes for their use in removal of accumulated carbonaceous deposits are also disclosed.

8 Claims, No Drawings

ANTI-POLLUTION HEATING OIL PRODUCTS AND PROCESSES

This is a division of application Ser. No. 112,961, filed Feb. 3, 1971, now abandoned.

The present invention relates to an anti-pollution heating oil composition and, more particularly, to an anti-pollution heating oil composition having reduced particulate emission characteristics upon combustion in an oil burner combustion chamber. Still more particularly this invention relates to a variety of compositions and processes useful for removing accumulated carbon deposits generally formed on the walls of and other parts within and leading from an oil burner combustion chamber.

It is well-known that most furnace heating oils emit a considerable amount of particulate carbonaceous compounds from the furnace exhaust system due to incomplete combustion of the hydrocarbon heating oil. The great majority of heating oils currently used as fuels in oil burner heating installations are characterized by a grading designation in which numbers 1, 2, 4, 5, and 6, are assigned to the various oil grades. Specifications for the various grades of oil (Bunker C oil being considered equivalent to No. 6) are based upon a variety of tests including the relative flash point, pour point, water and sediment content, carbon residue, ash residue, distillation, specific gravity, corrosion and viscosity of the respective grades. As used herein, the grades of fuel oils correspond to the tentative specifications for fuel oils of the American Society for Testing Materials (ASTM designation D396-66). As is well-known in the burner fuel oil industry, the exact physical characteristics for the different grades of fuel oils can vary from locale to locale within the United States as described in the United States Department of the Interior, Bureau of Mines publication, "Mineral Industry Surveys, Petroleum Product Survey No. 51, August, 1967" entitled "Burner Fuel Oils, 1967". As a general rule, kerosene and oils of Grade Nos. 1 and 2 are known in the trade as distillate fuel oils as they are the lighter fractions obtained upon cracking or distillation of crude oils. Fuel oil grades Nos. 4 through 6 are commonly termed "residual fuel oils" and are refinery by-products which are ordinarily sold for use in heavier duty heating installations, e.g. furnaces or boilers for large office buildings and hospitals, etc.

Problems of incomplete combustion, soot deposition, and sludge formation are common to a greater or lesser degree in all the above-mentioned heating oils when they are employed in oil burner installations. As a rule, the distillate fuel oils contain a stabilizing agent and may have most of their mercaptan content removed or converted to disulfides in order to improve their odor, as heating oil storage tanks are often located in heavily travelled areas, e.g. home basements. The problem of particulate emission is particularly acute in the case of household and industrial oil burners or furnaces utilizing grades 1 through 6 as Burner Fuel Oils. The particulate matter is comprised substantially of carbonaceous compounds formed as a result of incomplete combustion of the burner fuel oil and which emanate from the furnace or boiler exhaust system in the form of black exhaust smoke. These particulate carbonaceous contaminants create an air pollution problem and are currently a violation of local anti-pollution laws in many communities. In addition to constituting a source of serious environmental air pollution, these carbonaceous particles accumulate in the form of soot deposits on the walls, in the combustion chamber, and in the exhaust system of the oil burners in which they are generated. These deposits are largely due to incomplete burner fuel oil combustion, are cumulative in nature and eventually impair the efficient function of a heating installation by acting as heat-insulating materials and clogging boiler tubes and boiler or furnace exhaust passages.

The prior art is replete with a number of chemical compounds which are introduced into residual and distillate burner fuel heating oils for the purpose of promoting more complete combustion and decreasing the level of particulate emissions resulting from the incomplete combustion of the heating oil composition. These chemical additives can generally be classed as organo-metallic compounds, wherein the metal constituents include inter alia lead, copper, zinc, manganese, magnesium, cobalt and aluminum. Generally, these compounds are introduced into a burner fuel heating oil (grades 1 through 6) in an oil soluble form. Each of these respective organo-metallic compounds has been found to have individual drawbacks.

A common problem of these respective compounds is a tendency to destabilize and degrade the heating oils into which they are introduced, causing the hydrocarbon heating oil to polymerize and break down into a variety of insoluble gums and sludges. These insoluble gums may eventually clog the burner apparatus, thereby reducing the efficiency of the oil-burning system. A further significant detriment of these prior art heating oil additives is the toxic or pollutant nature of their combustion products when these products are emitted into the environmental atmosphere from the smokestack or exhaust system of a heating plant along with the previously mentioned hydrocarbon combustion products. For example, lead, which is the preferred metallic additive forms several oxide compositions upon combustion which are potentially hazardous to human health.

Therefore, although it is well-known that these metal compounds have the capability of lowering the ignition temperature of residual carbon deposits by catalysis enabling the oxidation and removal of these deposits at relatively low temperatures, their detrimental effects in the heating system itself and, more particularly, in the environment have created a need for a more efficient, non-polluting burner fuel heating oil composition.

In addition, the need has arisen for a composition and process useful in the safe removal of carbonaceous deposits which accumulate in the form of soot on the various combustion chamber surface areas, exhaust passages, and boiler tubes, in furnaces, boilers and other oil burner heating systems. Although several forms of chemical soot removers are currently in use, these compounds have certain detrimental features which make them undesirable for general applications.

For example, solid soot-removers including inter alia the nitrate salts of potassium and sodium in the form of powders or briquettes are often used to remove accumulated soot deposits. These compounds are characterized by a potentially dangerous oxidation technique which rapidly ignites the accumulated soot deposit at an elevated temperature.

A further type of solid soot-remover incorporates lead salts in order to decrease the oxidation rate and improve the safety of the soot-removal technique. The combustion of these lead-containing soot-removing compounds releases substantial amounts of lead oxides into the atmosphere. These lead oxidation products have a cumulative toxic effect when inhaled by humans and are therefore detrimental atmospheric contaminants from the standpoint of air pollution.

A different type of widely used soot remover is known in the trade as a burner cleaner and generally consists of a lead or copper organo-metallic compound in liquid form. The composition is introduced directly into an oil burner furnace by spraying the composition directly onto the accumulated carbon deposits when the heating system is in operation. The burner cleaner composition acts to catalytically lower the ignition temperature of the carbon or soot deposits onto which it has been sprayed, enabling them to be consumed by oxidation at relatively low temperatures. The preferred composition for this variety of soot-remover contains large quantities of lead compounds whose combustion products carry significant amounts of lead pollutants into the environment. Since it is well-known that lead is a systemic poison which may be cumulatively adsorbed ultimately causing human organic dysfunction, the elimination of lead contaminants from the atmosphere renders the aforementioned lead-containing soot-removal compositions generally undesirable.

The burning of all grades of burner fuel heating oils results in the emission to some extent of soot or unburned hydrocarbon carbon compounds. The relative amounts of unburned carbon deposited on the various surfaces of a combustion chamber is dependent upon the relative purity of the respective fuel oil employed in the oil burner, and also by the efficiency of the equipment used to burn the heating oil.

It is an object of this invention to provide an antipollution heating oil composition for use in oil burners.

Another object of this invention is to provide an anti-pollution heating oil composition having a reduced level of emission of particulate carbonaceous materials upon combustion.

A further object of this invention is to provide an anti-pollution heating oil composition capable of removing accumulated carbonaceous or soot deposits from the walls and surfaces of an oil burner system in which said heating oil composition is being used.

A still further object of this invention is to provide a heating oil composition having a residual soot-removing effect for use in oil burning heating systems.

A still further object of this invention is to provide a heating oil composition including a soot-removal agent which yields no objectionable pollutant by-products upon combustion.

Another object of this invention is to provide a number of chemical compositions capable of catalyzing the removal of accumulated carbon deposits from a surface by lowering the temperature at which such deposits will oxidize.

A still further object of this invention is to provide a chemical composition useful in reducing the smoke emission from an oil burner.

Another object of this invention is to provide a method of removing accumulated carbonaceous or soot deposits from the heating surfaces communicating with oil burner combustion chambers and the like.

The anti-pollutant heating oil compositions of this invention comprise a burner fuel heating oil and a lithium compound. The lithium compounds useful in the anti-pollutant heating oil compositions of this invention include organic lithium compounds which are soluble in hydrocarbon burner fuel oils and inorganic lithium compounds which can be dispersed in these burner fuel oils.

The hydrocarbon heating oils useful in the compositions of this invention include conventional burner fuel heating oils of grades 1, 2, 4, 5 and 6, as described in ASTM designation D396-66 (1966). It will be understood that specific physical characteristics within each of these grades of heating oils may vary slightly from location to location. It has been found that the dissolution or dispersion of a small amount of an organic or inorganic lithium compound in any of the previously mentioned grades of heating oil significantly can improve its combustion characteristics in the following fashion.

Upon combustion of the improved heating oil compositions of this invention is a conventional oil burner, the active metallic substance of the invention is oxidized and the oxidized lithium containing component is coated onto the soot-covered surfaces of the respective oil burner, furnace or boiler, where it acts catalytically to lower the ignition temperature of the accumulated carbonaceous soot deposits. These carbonaceous deposits are then eliminated at the normal operational temperatures existing within the oil burner when using a conventional grade 1-6 burner fuel oil. It has been found that this burn-off or oxidation of accumulated carbon or soot is accomplished even in those oil burner systems which are badly out of adjustment.

In addition to the removal of existing soot, the compositions in this invention decrease the amount of particulate carbonaceous material that is created upon combustion of the burner fuel oil by catalyzing the carbon in the hydrocarbon oil (in its gaseous state) at the moment of combustion. In this manner, the carbon is oxidized within the combustion chamber of the oil burner before it can be deposited on a heating system surface. In this respect, the compositions of this invention are capable of causing an appreciable reduction in the amount of black exhaust smoke emitted from the chimney or smokestack of an oil burner heating plant. In effect, the majority of particulate carbonaceous by-products of incomplete combustion are almost instantly oxidized, thereby providing more efficient utilization of the burner fuel as well as eliminating emission of these particulate materials into the atmosphere, where they constitute atmospheric pollutants.

The heating oil compositions of this invention further prevent the creation of soot by decreasing the surface-free energy of each individual oil droplet which is formed as the burner fuel oil composition is atomized through the oil burner nozzle. These droplets then tend to break up into finer micro-droplets which in turn allow for more advantageous admixture of oxygen and fuel and therefore aid in more efficient and complete combustion of the fuel.

The heating oil compositions of this invention tend to display an enhanced stability and may be stored for longer periods of time than might normally be expected before undergoing polymerization and breakdown into gums and sludges.

Additionally, the heating oil compositions of this invention have been found to inhibit against corrosive attack of the heating oil storage tank and communicating piping, valves, burners, boilers, furnaces and stacks, due to corrosive impurities commonly found in furnace heating oils. The improved anti-pollutant heating oil compositions of this invention have not been found to cause deleterious chemical attack on any portion of the conventional oil burner heating system.

The anti-pollutant fuel oil compositions of this invention are further desirable in that they aid in preventing the accumulation of fire scale on the heat exchange surfaces of a boiler or furnace. This action is due to the ability of the metallic lithium compound to catalyze the oxidation of the accumulated carbonaceous deposits entrapped in the fire scale, thus rendering the fire scale porous and fragile. In addition, the lithium compounds of this invention are relatively alkaline and react on the surface of the acidic fire scale to aid in the disintegration of this scale into an easily removable form.

It will be appreciated that optimum elimination and prevention of fire scale will be obtained when the lithium compound employed in the heating oil compositions of this invention has a high pH. Generally, the more alkaline the lithium composition employed, the greater is the degree of fire scale elimination and prevention which will be noted.

The lithium containing anti-pollutant burner fuel heating oil compositions of this invention tend to emit reduced levels of sulfur oxides upon combustion when employed in conventional oil burning equipment, due to the excellent reducing qualities of lithium.

A broad range of lithium compounds are useful in the improved heating oils of this invention, the only limitation being that the lithium compound must be soluble or dispersible in the respective grades 1, 2, 4, 5, and 6, of burner fuel heating oil.

The anti-pollutant heating oil compositions of this invention are prepared by merely adding the respective lithium compound to the desired grade of burner fuel oil at any stage of production after final cracking and prior to combustion in the desired furnace or oil burner heating system. Among the preferred organic lithium compounds useful in the anti-pollutant heating oil compositions of this invention are lithium carboxylates, including aliphatic, aromatic and heterocyclic lithium salts of carboxylic acids. The preferred inorganic lithium compounds useful in this invention are lithium hydroxide, lithium oxide, lithium halides, lithium nitrates and nitrites, and lithium carbonates. The major parameter for utilization of a lithium compound in the anti-pollutant heating oil compositions of this invention is that the compound be soluble or dispersible in the respective grades of heating oils, and any class of organic or inorganic lithium compound which satisfies this requirement will function effectively in the heating oil compositions of this invention.

Particularly preferred organic compounds include lithium naphthenate, lithium stearate, lithium neodecanate, and aromatic, aliphatic, and heterocyclic lithium carboxylates having from 6 to 18 carbon atoms in the hydrocarbon backbone. Based upon the concentration of lithium in the lithium formulation employed, compositions containing as little as 0.165 parts per million by unit weight of lithium per unit volume of hydrocarbon heating oil can be used. The effects of the invention can be amplified by increasing the amount of lithium present in the respective burner oil composition. Stated in other words, the effects of the invention are cumulative and cause reduction in the level of particulate carbonaceous emission. Oxidation of accumulated soot and the residual soot-removing capability can also be amplified by increasing the dosage of lithium in a given burner oil grade. The amount of lithium necessary to provide satisfactory attenuation of particulate soot emission and optimum prevention of soot deposition will be different for each grade of heating oil. Generally, the higher number grades or residual oils (Nos. 4, 5 and 6) will require greater amounts of lithium per unit weight of heating oil to achieve a reduction in particulate emission level equivalent to that obtainable with a lesser amount of lithium in a distillate of lower grade (No. 1 or 2) heating oil.

The inorganic or organic lithium compounds of this invention may be introduced into the heating oil in any appropriate fashion. Depending upon the particular lithium compound employed, various surface active agents, solvents or co-solvents, or combinations of these, may be required to obtain the anti-pollutant heating oil compositions of this invention. Among the solvents and co-solvents useful for this purpose are petroleum distillates such as benzene, toluene, substituted and unsubstituted aromatic, aliphatic and heterocyclic compounds, a wide range of fatty acids, soaps, mineral oils and vegetable oils. Alcohols, various surface active agents and aqueous solutions may be used as required. The use of a particular surfactant, solvent or co-solvent is not critical to functioning of the invention. Any solvent, surfactant or co-solvent may be used either individually or in combination provided they aid in dissolving or dispersing the respective organic or inorganic lithium-containing compound in a given grade of burner fuel oil. The appropriate solvent or cosolvent for use with a given lithium compound will be well known to those skilled in the art.

In actual operation, the anti-pollutant heating oil compositions of this invention emit measurably less particulate carbonaceous matter upon combustion in a given oil burner or furnace when compared to heating oil compositions not prepared in accordance with this invention. If the improved anti-pollutant heating oil compositions of this invention are burned in a furnace or boiler having a heavy soot accumulation, it is found that after 3–4 weeks normal operation the accumulated soot deposit has been substantially oxidized, leaving a relatively soot-free surface.

The oil soluble or dispersible lithium compounds useful in the anti-pollutant heating oils of this invention act as a vehicle to carry the lithium metal through the heating system so that it is deposited on otherwise inaccessible surfaces where it acts to prevent the accumulation of soot deposits, reduce smoke exhaust and aid in the elimination of existing soot deposits.

A further property of the anti-pollutant heating oil compositions of this invention is their residual soot-removing activity.

After an anti-pollutant heating oil made in accordance with this invention has been used in an oil burner for a given period of time, a residual soot-removing action is observed. If the burner is switched back to a burner fuel oil which does not contain the lithium compounds of this invention, the burner will continue to operate with a low level of particulate carbonaceous emissions and to resist the accumulation of carbonaceous soot deposits on heating surfaces and passages for some time, without further treatment. The length of time during which this residual activity will be effective will differ depending upon the particular fuel oil composition, the amount of lithium compound employed in the composition, and the length of time the burner has been operated using the anti-pollutant heating oils of this invention.

It is further noted that a lower air intake is required when the improved heating oil compositions of this invention are used in an oil burner system. This indicates a change in flame characteristics which aids in reducing the amount of particulate carbonaceous matter emitted and increasing the efficiency of the oil burner operation.

A further aspect of this invention comprises a lithium-containing composition useful in catalytically removing accumulated carbonaceous deposits.

The lithium compositions of this invention may be compounded with an initiator compound and a filler compound to provide a powdered form catalytic soot remover. The powdered formulation is dusted or blown onto a soot or fire scale covered surface within an oil burner, furnace, boiler, smokestack or exhaust system. The soot is then removed by either igniting the powdered formulation with a direct flame (i.e. paper-torch) or merely placing the boiler or furnace into normal operation. The residual soot deposit is oxidized and substantially eliminated at a lower temperature than would normally be required to eliminate the deposit. In addition to removing existing accumulated soot deposits the powdered catalytic soot-removing compositions of this invention also have a continuing soot-oxidizing effect and will prevent the further deposition of soot-like carbonaceous deposits for an extended period without further application of the composition.

Any material which will ignite with organic material when heated is useful as an initiator compound in the catalytic soot-removing composition. More specifically, sodium, potassium, and lithium nitrates, chlorates and perchlorates, are particularly preferred as initiators.

A wide variety of inert ingredients which will dry, enhance, and dilute the active ingredients, and which will burn when ignited along with the accumulated soot deposit are suitable for use as filler materials. Preferred filter materials include wood flour, starches, dextrines, sugars, corncob powders, etc.

Catalytic soot-removing compositions of this invention can also be formulated as soot stick compositions which can be employed by merely placing the composition in the oil burner combustion chamber, rather than by blowing or dusting as is necessary with the powdered formulation. The soot stick is particularly useful for depositing the catalytic soot-removing composition on boiler surface and otherwise poorly accessible components of the boiler or furnace system.

As will be evident to those skilled in the art, these catalytic soot-removing compositions can also be formulated in tablet or briquette form by varying the amount of filler present. A tablet formulation is particularly useful as it may also be dropped into the fire box. The tablet, briquette and soot stick preparations enable the release of a catalytic soot-removing composition almost immediately upon placing the burner in operation and provide inter alia rapid soot-removal treatment of a boiler or furnace which is heated by the oil burner system.

A still further variation of this invention may be obtained by formulating the catalytic soot-removing composition in the form of an aerosol or spray which may be propelled by a suitable propellant composition, e.g. Freon, air pressure, carbon dioxide, or nitrous oxide. The catalytic soot-removal spray composition may be prepared in either oil soluble or water soluble form. As will be evident, the catalytic soot spray composition may be easily applied to an accumulated soot deposit after which it may be ignited with either a direct flame, as in the case of the powdered composition, or by the environmental temperatures existing within the oil burner during normal operation.

All the catalytic soot-removing compositions of this invention function to lower the ignition temperature of the carbonaceous soot deposits so that they oxidize at a relatively lower temperature. This enables the soot removal to be accomplished by merely touching an open flame to the treated soot-covered area and without igniting the oil burner apparatus when the powder or spray compositions are employed. In all cases of soot removal, exhaust smoke reduction and residual soot elimination, the activity is accomplished without the addition of toxic pollutant compounds to the external atmospheric environment.

A typical aerosol spray formulation would comprise an oil-soluble lithium soap in mineral spirits or a water-soluble form of lithium which would comprise approximately one-third of the weight of the entire formulation.

Optimally, at least 0.01 parts by weight of lithium (metal) is employed per unit weight of catalytic soot spray, powder, tablet or stick composition.

Use of the heating oil compositions of this invention has an additional beneficial effect in that a deposit of lithium is built up over any extended period of use. In this manner, the oil burner may be shut down at any time, and a match touched to a soot-covered surface will ignite the lithium-coated soot-covered area. The soot will be oxidized immediately and catalytically consumed in the usual fashion, with a glowing oxidation front spreading out in all directions until all lithium-coated surfaces are free of soot.

Due to its low molecular weight, the lithium ash residue resulting from the catalytic soot removal is of a very low quantity and far less than that deposited by the prior art lead-based soot-removers.

The combustion of the anti-pollution heating oil compositions and catalytic soot-removal compositions of this invention result in no toxic or pollutant combustion products being added to the atmosphere. The only lithium compound for which a limiting atmospheric concentration has been set is lithium hydride, which is not a combustion product of either the heating oil compositions or the catalytic soot-removing compositions of this invention. Lithium is generally considered to have a lower possibility of reaching toxic concentrations in the atmosphere as compared to lead and other metals commonly used for soot removal.

The invention will be further illustrated by, but is not intended to be limited to the following examples.

EXAMPLE I

A 4-horsepower, low pressure steam boiler using a conventional ASTM grade 2 heating oil was intentionally regulated to emit a thick black smoke in order to allow a heavy deposit of soot to accumulate over a 48-hour period, to a thickness of 3/16 of an inch. The flame was adjusted to provide a No. 4 smoke reading (on the Bachrach scale) and fired once again for 24 hours and again checked. The soot remained at 3/16 of an inch thickness. 60 liters of No. 2 heating oil was placed in a drum and a solution of 120 grams of 0.5% lithium as naphthenate in mineral spirits was poured into the No. 2 heating oil composition.

The burner was switched to the lithium-containing fuel, but no change was made in flame and smoke settings from tests previously run. After ignition the smoke reading gradually diminished to No. 2 on the Bachrach scale, and the flame became quite sharp indicating a need for a lower air intake. After 48 hours of intermittent firing, the steam pressure of the boiler equalized more quickly and shorter firing times were required. After 72 hours the tube area of the boiler was opened for examination and it was noted to be almost completely soot-free.

The boiler was again closed and a separate fuel tank containing 60 liters of untreated No. 2 heating oil was connected to the burner and the burner ignited. After 48 hours the boiler was reopened and found to be coated with ⅛ inch soot. A match flame was used to touch a soot-covered spot whereupon the soot immediately began to oxidize, a glowing oxidation front spreading out in all directions until all the soot-coated surfaces of the boiler were substantially soot-free.

EXAMPLE 2

The same procedure was used as in Example 1, with the exception that 120 grams of a solution of lithium neodecanate (2% lithium as the neodecanate in excess neodecanoic acid and mineral spirits) was added to 60 liters of No. 2 fuel oil. A gradual diminishing of exhaust smoke was noted after switching the burner to operate from the lithium-containing heating oil. Substantially complete soot removal was noted after initial burner operation with the lithium-treated heating oil. After redeposition of soot by switching the burner to operate with an untreated grade No. 2 fuel oil supply and operating for 48 hours, a match flame was used to touch a spot of soot-covered metal in the boiler. Again, the soot immediately ignited and was substantially consumed in the manner previously observed.

EXAMPLE 3

The same procedure was employed as in Example 2, except that a solution consisting of 10 grams of 2% lithium neodecanate in 90 grams of petroleum distillates was dissolved in 60 liters of No. 2 fuel oil. The results were similar in all respects to Example 2 in both reduced smoke emission and soot removal.

EXAMPLE 4

The same procedure was followed as in Example 3, except that 10 grams of an aromatic lithium carboxylate (lithium benzoate) containing 1% lithium by weight was dissolved in 90 grams of petroleum distillates. This solution was then added to 74 liters of No. 2 fuel oil and the same procedure followed as in Example 3. A similar reduction in exhaust smoke content, and soot-removal was noted. Residual soot-removal activity was also noted after switching back to the untreated fuel oil composition by merely touching a soot deposit area with an open match flame.

EXAMPLE 5

Five hundred grams of a solution of 2% lithium naphthanate in excess naphthenic acid, carboxylic acids and mineral spirits (2% lithium by weight) was added to 60 liters of No. 2 heating oil and the procedure outlined in Example 1 was carried out, using a 60 liter sample of the same untreated No. 2 fuel oil as the control. A gradual reduction in exhaust smoke output was noted after 3 hours of operating the burner from the lithium-treated heating oil. Almost complete elimination of the 3/16 inch soot accumulation was observed after operating the burner for 1 week with the treated heating oil composition. Catalytic consumption of residual soot accumulations resulting from operation with an untreated No. 6 heating oil was observed as in Example 1 by merely contacting a portion of the soot-covered surface with an open match flame.

EXAMPLE 6

Twenty-five grams of lithium oxide, 5 grams of barium neodecanate, and 65 grams of solvent NJ-E2 (American Mineral Spirits Corporation, mixture of high aromatic distillates, boiling temp. 505° F, spec. gravity 8.32 lbs/gal., ASTM distillation end point 660° F) and 5 grams of sodium petroleum sulfonate were ball milled for 8 hours and the resulting mixture was dispersed in 100 liters of No. 4 heating oil. The 100-liter heating oil supply was connected to a 50-H.P. Scotch marine fire tube low pressure steam boiler which had approximately ⅛ to ¼ of an inch of soot deposited on the tubes, and front and rear chambers resulting from operation on a standard No. 6 heating oil, on an intermittent basis (approximately eight hours per day, six days per week) with a flame intentionally adjusted to yield an exhaust smoke reading of No. 5 on the Bachrach scale.

The Scotch marine boiler was switched over to operate using the above-mentioned heating oil dispersion to supply the burner, and run approximately eight hours a day on an intermittent basis for three weeks. A gradual diminution in the exhaust smoke level to a reading of No. 4 on the Bachrach scale was noted during the first week of operation. Upon inspecting the boiler tubes and front and rear chambers at the end of three weeks, a noticeable decrease in the level of soot deposits was observed. At this time a lighted paper torch was touched to a soot-covered area on the front chamber. The soot ignited and a glowing oxidation front spread in all directions from the area contacted by the open flame of the paper torch and consumed substantially all of the remaining soot deposits.

The boiler was reconnected to operate from an untreated supply of standard No. 4 heating oil. The exhaust smoke continued to be emitted at a reduced level (approximately No. 4 on the Bachrach scale). After two weeks of normal intermittent operation (eight hours per day, six days per week) on the standard No. 4 heating oil, the boiler was shut down and the tubes and front and rear chambers were inspected and found to be substantially soot-free.

EXAMPLE 7

A lithium salt dispersion was prepared as follows: 100 grams of laboratory grade lithium carbonate was dispersed in 500 grams of barium petroleum sulfonate. This mixture was then dispersed in 500 grams of petroleum distillates. The entire mixture was ball-milled for approximately 8 hours until relatively uniform dispersion was obtained, and then added to 60 liters of No. 4 fuel oil. The same test procedure and equipment were used as in Example 6. A noticeable reduction in smoke emission was observed. After 3 weeks of operation the tube area on the boiler was noted to be almost completely soot-free. After switching back to operation from an untreated heating oil (No. 4) and burning for 48 hours, a minimal soot deposit accumulated which was oxidatively consumed upon touching an open match flame to a spot of soot-covered metal near the front plate of the boiler.

EXAMPLE 8

An organic lithium dispersion was prepared as in Example 7 by ball milling the following ingredients for approximately eight hours: 100 grams lithium hydroxide, 20 grams lithium naphthenate, 20 grams sodium petroleum sulfonate, 500 grams magnesium carbonate, and 1000 grams solvent HJ-E2 (American Mineral Spirits Corporation- mixture of high aromatic solvents). This dispersion was added to 60 liters of No. 4 heating oil and used to carry out the procedure and with the apparatus described in Example 7. The results were similar to those obtained in Example 7, and included a noticeable reduction in smoke emission to a lower reading on the Bachrach scale and a noticeable degree of soot removal during the initial period of operation with the lithium-treated heating oil. After twenty-one days of operation with the treated heating oil composition, the boiler was shut down and an open match flame was touched to the soot-deposited area. Catalytic oxidation and consumption of substantially all the remaining soot deposits was observed. The oil burner was switched back to operate from an untreated No. 4 heating oil supply for two weeks as in Example 7, and the level of exhaust smoke remained at No. 4 on the Bachrach scale throughout this period. Some soot deposition was observed upon inspecting the boiler tubes and the front and rear chambers. These soot deposits were almost completely eliminated by touching an open match flame to a soot-covered area.

EXAMPLE 9

An oil-soluble catalytic soot-removing lithium spray was prepared by mixing 600 parts by weight of lithium neodecanate (2% lithium) and 100 parts by weight of mineral spirits, 300 parts Freon 11, and 300 parts by weight of Freon 12 (propellant) in a suitable pressurized container. Two tinned 4-inch sheet metal discs were covered with lamp black on one side and one of the discs was sprayed with a small amount of the lithium spray composition. Upon touching an open match flame to the sprayed portion of the coated disc, an immediate oxidation reaction was initiated and spread uniformly and rapidly across the soot-covered area which had been contacted by the spray composition. An essentially complete removal of the carbonaceous deposit was observed to be confined to the area contacted by the spray composition. Upon touching an open match flame to a soot-covered portion of the untreated control, neither a reaction nor any soot removal was observed.

EXAMPLE 10

The following soot spray compositions were prepared:

COMPOSITION A

2% lithium soap (neodecanate) 500 parts by weight; ortho-dichlorobenzene 300 parts by weight; propellant No. 11 (Freon) 200 parts by weight; propellant No. 12 (Freon) 300 parts by weight.

COMPOSITION B

2% lithium soap (neodecanate) 400 parts by weight; trichloroethylene 100 parts by weight; methylene chloride 100 parts by weight; propellant No. 11 (Freon) 100 parts by weight; propellant No. 12 (Freon) 300 parts by weight.

COMPOSITION C

2% lithium soap (naphthenate) 400 parts by weight; triethanolamine 100 parts by weight; methylene chloride 300 parts by weight; propellant No. 12 (Freon) 300 parts by weight.

COMPOSITION D

2% lithium soap (naphthenate) 200 parts by weight; mineral spirits 100 parts by weight; methylene chloride 200 parts by weight; ethylene dibromide 200 parts by weight; propellant No. 12 (Freon) 300 parts by weight.

COMPOSITION E

Lab. grade (20%) butyl lithium 100 parts by weight; kerosene 200 parts by weight; propellant No. 11 (Freon) 400 parts by weight; propellant No. 12 (Freon) 300 parts by weight.

COMPOSITION F

2% lithium naphthenate 300 parts by weight; mixture of C3-C10 alcohols 250 parts by weight; methylene chloride 150 parts by weight; propellant No. 12 (Freon) 300 parts by weight; 300 parts by weight of Freon 11.

COMPOSITION G

2% lithium neodecanate 300 parts by weight; mixture of C3-C10 alcohols 250 parts by weight; methylene chloride 150 parts by weight; propellant No. 12 (Freon) 300 parts by weight; 300 parts by weight of Freon 11.

Compositions A through G were used to fill suitable individual spray containers. Eight individual tinned discs were coated with lamp black as in Example 9. A quantity of each composition A through G was sprayed onto a soot-covered portion of one tinned disc. The eighth disc was not treated and retained as a control. An open match flame was touched to the sprayed portion of each disc and resulted in an immediate oxidation reaction characterized by a glowing oxidation front which removed the carbonaceous lamp black deposit from the area on each disc which was contacted by the soot spray. Touching an open match flame to the untreated soot-covered tinned disc resulted in no reaction or appreciable soot removal.

EXAMPLE 11

A group of water soluble catalytic lithium soot-removal sprays were prepared as follows:

COMPOSITION A

Lab. grade (20%) lithium chloride 5 parts by weight; isopropyl alcohol 25 parts by weight; water 40 parts by weight; propellant No. 12, 30 parts by weight.

COMPOSITION B

Concentrated lithium hydroxide 2 parts by weight; isopropyl alcohol 20 parts by weight; oleic acid 4 parts by weight; water 44 parts by weight; propellant No. 12, 30 parts by weight.

COMPOSITION C

Concentrated lithium hydroxide 10 parts by weight; 5% acetic acid 25 parts by weight; mixture of C3-C8 alcohols 10 parts by weight; water 25 parts by weight;

propellant No. 12, 30 parts by weight.

Compositions A through C were loaded into individual suitable aerosol containers. Four tinned discs were coated with a carbonaceous deposit as in Example 10. Disc No. 1 was sprayed with a small amount of Composition A; disc No. 2 was sprayed with a small amount of Composition B; and disc No. 3 was sprayed with a small amount of Composition C. The fourth disc was not treated and retained as a control. Upon touching an open match flame to the treated soot-covered portions of discs 1 through 3, an immediate oxidation reaction was initiated and soot was removed from those areas of discs 1 through 3 which had been contacted by the respective spray compositions. Touching an open match flame to a soot-covered portion of the untreated control disc No. 4 produced no reaction or soot removal.

EXAMPLE 12

A soot-remover tablet was prepared as follows: 15 parts by weight of lithium soap; 15 parts by weight of lithium carbonate; and 20 parts by weight of sodium carbonate were compounded with an inert filler (wood flour) and 5 parts by weight of a suitable inert filler (wood flour).

EXAMPLE 13

A series of powdered soot-remover formulations was prepared as follows:

COMPOSITION A

2% lithium stearate 10 parts by weight; wood flour 55 parts by weight; potassium nitrate 5 parts by weight; sodium chloride 25 parts by weight.

COMPOSITION B

2% lithium stearate 10 parts by weight; wood flour 65 parts by weight; sodium chloride 25 parts by weight.

COMPOSITION C lithium chloride 5 parts by weight; sodium chloride 30 parts by weight; wood flour 65 parts by weight.

COMPOSITION D lithium carbonate 5 parts by weight; potassium nitrate 5 parts by weight; sodium chloride 25 parts by weight; wood flour 65 parts by weight.

Composition A contained lithium stearate having 1% lithium; Composition B contained lithium stearate having 2% lithium; Composition C employed laboratory grade lithium chloride; and Composition D contained laboratory grade lithium carbonate.

A horizontal tube boiler of the type having access doors exposing the ends of the tubes and which had approximately 3/16 of an inch of evenly distributed soot on the surface of the tubes was employed to test samples A–D. A small portion of Composition A was dusted on all exposed soot-covered surfaces. The oil burner was then ignited and run for 12 hours before examining the soot-covered surfaces. Upon inspection, almost no soot was found to be present on those surfaces which previously had a coating of approximately 3/16 of an inch of evenly distributed soot. Compositions B through D were tested under the same conditions on the same oil burner installation after approximately 3/16 inch of soot had been built up in normal operation from a standard No. 2 heating oil. Compositions B-D all displayed soot-removal qualities after several hours of normal burner operation.

EXAMPLE 14

Several soot sticks were prepared as follows:

COMPOSITION A lithium oleate (2% lithium) 10 parts by weight; sodium chloride 55 parts by weight; wood flour (safe type) 35 parts by weight.

COMPOSITION B lithium oleate (2% lithium) 10 parts by weight; sodium chloride 55 parts by weight; powdered iron 10 parts by weight; wood flour 25 parts by weight.

COMPOSITION C lithium chloride 20 parts by weight; sodium chloride 30 parts by weight; powdered iron 5 parts by weight; wood flour 45 parts by weight.

Compositions A, B and C were formed into ¾-inch diameter soot-removal sticks approximately 5 inches in length.

Compositions A, B and C, respectively, were placed in the combustion chamber of conventional oil burners using No. 2 heating oil. Approximately 3/16 of an inch of soot was noted to be deposited on the heating surfaces of each burner system prior to treatment with the respective compositions. Each of the burners was ignited and run for 12 hours after which time the combustion chamber surfaces were inspected. The surfaces of the burners treated with Compositions A, B and C were found to be substantially soot-free.

EXAMPLE 15

9.75 grams of 2% lithium neodecanate in excess neodecanoic acid and mineral spirits (2% lithium metal) was dissolved in 1000 liters of No. 4 heating oil.

A 50-H.P. Scotch marine fire tube low-pressure steam boiler which had been run for several weeks (for an average of eight hours per day, six days per week), using an untreated No. 4 heating oil, and which had an exhaust smoke reading of 5 on the Bachrach scale, was switched to operate from the heating oil composition prepared above. The tubes and front and rear chambers of the boiler contained approximately a ⅛ inch to ¼ inch soot deposit.

The boiler was placed in operation using the new heating oil supply and the tubes and chamber periodically examined for soot removal activity. A smoke reading was made simultaneously with a soot-removal inspection.

After six days of operation on the new heating oil the smoke reading had decreased to 4.5 on the Bachrach scale and no appreciable soot removal was noted. After sixteen days the smoke reading was 4.5 on the Bachrach scale and no appreciable soot removal was observed. After twenty-two days' operation the smoke reading was 4.5 on the Bachrach scale and some soot removal was apparent at the junction of the combustion chamber plates and several of the boiler tubes. After thirty-one days, the smoke reading had decreased to No. 4 on the Bachrach scale and appreciable soot removal was apparent at the lower front plate and on most boiler tubes. The soot-covered area was contacted with an open match flame, igniting the remaining soot deposits, which were consumed by a glowing oxidation front.

EXAMPLE 1

The identical boiler, fuel grade, and original soot deposition conditions were employed as in the preceding example.

After ⅛ inch to ¼ inch of soot had been deposited on the tubes, and front and rear chambers of the boiler, it was switched over to operate from a supply of No. 4 heating oil in which the concentration of 2% lithium neodecanate was brought to 130 grams per thousand liters of No. 4 fuel oil. A subsequent increase in soot removal activity was noted. After six days the smoke reading had decreased to No. 4 on the Bachrach scale.

The burner was then switched to operate from a No. 4 fuel oil supply containing 260 grams per thousand liters of heating oil. After six further days of normal operation, the exhaust smoke reading had decreased to No. 3 on the Bachrach scale and only trace amounts of soot remained in the tubes and around the chamber surfaces.

EXAMPLE 17

To 1,000 liters of No. 6 heating oil was added 260 grams of 2% lithium neodecanate in excess neodecanoic acid and mineral spirits (2% lithium metal).

A 100-H.P. Scotch marine fire tube low-pressure steam boiler which had been operated intermittently twenty-four hours a day for several weeks using a standard untreated No. 6 heating oil, was used in this test series. The Scotch marine boiler had been operated with a smoke emission level of No. 6 on the Bachrach scale. Before operations were begun with the oil supply prepared above, an examination of the boiler tubes and front and rear chambers revealed them to be covered with between ¼ inch and ½ inch of carbonaceous soot. The boiler was switched over to a fuel tank containing the above prepared lithium containing No. 6 heating oil and was run under the same conditions as with the untreated No. 6 heating oil.

After ten days of operation with the new heating oil composition, the exhaust smoke level had been reduced to a No. 4 reading on the Bachrach scale. Examination of the lower areas of the front and rear boiler plates revealed them to be almost completely soot-free. Some soot deposits remaining on the upper segments of the front and rear plates ignited spontaneously on opening the combustion chamber door of the heated boiler.

After twenty-one days the exhaust smoke level was reduced to No. 3 on the Bachrach scale. An inspection of the tube chamber revealed that a substantial amount of the soot which had been deposited in that area had been removed.

EXAMPLE 18

The following anti-pollutant heating oil compositions were prepared.

COMPOSITION A 20 grams of butyl lithium was dissolved in 80 grams of xylol and this composition was then dissolved in 80 liters of No. 2 heating oil.

COMPOSITION B 20 grams of phenyl lithium was dissolved in 80 grams of ethyl ether-benzene and this mixture was then dissolved in 100 liters of heating oil.

COMPOSITION C 20 grams of alpha-picolyl lithium was dissolved in 60 grams of xylol and 20 grams of isopropanol, and this solution was added to 1000 liters of No. 2 heating oil.

COMPOSITION D 20 grams of dimethylaminophenyllithium was dissolved in 20 grams of isopropanol and 60 grams of xylol. This composition was then added to 500 liters of No. 2 heating oil.

COMPOSITION E 10 grams of 2,6-dimethyloxyphenyllithium was dissolved in 20 grams of isopropanol and 70 grams of xylol. This mixture was then added to 100 liters of No. 2 heating oil.

COMPOSITION F 20 grams of lab. grade lithium butoxide was dissolved in 60 grams of xylol and 20 grams of isopropanol. One-half of the foregoing mixture (50 grams) was added to 1000 liters of No. 2 heating oil.

COMPOSITION G 10 grams of lithium benzoate was dissolved in 30 grams of isopropanol and 60 grams of xylol. This mixture was then added to 100 liters of No. 2 fuel oil.

Anti-pollutant heating oil compositions A through G were then employed as heating oils in the 4-H.P. steam boiler used in Example 1. In each case, the boiler tubes and plates were first coated with at least ¼ inch of soot by running the boiler for several days with an untreated No. 2 heating oil after the residual soot-removing activity of the previous anti-pollutant heating oil composition was no longer present. No adjustments were made to the burner flame or to any other portion of the burner apparatus throughout the test series, and the only variable in each case was the heating oil supplied to the burner.

In all cases, after between three and six days of normal burner operation using the anti-pollutant heating oil compositions (A through G), a diminution in exhaust smoke (generally about one unit lower on the Bachrach scale) was apparent. Generally, after about three to four weeks of operation with any of the above-mentioned compositions (A through G), a noticeable amount of soot had been removed from the front and rear plates of the boiler. In all cases (after four weeks of operation using any one of the compositions A through G), residual soot deposits ignited and were consumed upon touching an open match flame to any soot-covered heating surface within the unit.

A residual soot-removing effect was noted for all of the above-mentioned compositions A through G. The length of time during which the residual soot-removing effect was apparent varied from one composition to another, but generally was on the order of four to seven days after approximately twenty-eight days' operation using an anti-pollutant heating oil composition.

It will be appreciated from the foregoing examples that the amount of lithium metal necessary in the respective antipollutant fuel, soot-removing powder, spray, stick or tablet, must be varied depending upon the particular oil burner apparatus with which it is used and the quality and grade of fuel used in the respective oil burner. The residual soot-resisting effects resulting from the use of the compositions of this invention in an oil burner will vary from several hours to several weeks depending upon inter alia the amount of lithium metal employed in the treating composition, and the respective heating oil compositions with which they are employed. In this respect, it should be noted that inorganic lithium dispersions will also function in the anti-pollutant heating oil compositions of this invention. These dispersions function with the same weight of lithium metal per unit volume of heating oil in use, as do the oil-soluble lithium compounds of this invention. Generally, at least 0.165 parts per million by weight of lithium metal is required per unit volume of heating oil to achieve a suitable anti-pollutant, or soot-removal effect.

In the catalytic soot-removing formulations of this invention, i.e. powders, sprays, sticks and tablets, the preferred formulations contain approximately 0.1 percent of metallic lithium based on the weight of the entire composition, although compositions containing as little as 0.05 percent by weight of metallic lithium are effective. The soot-removing activity will of course increase as the amount of lithium employed in the composition is increased.

The anti-pollutant heating oil compositions of this invention provide a distinct advantage over the heating oil additives currently in use and, in particular, those which employ lead as an anti-polluting agent in that they emit no toxic combustion products which may act to pollute the atmosphere.

The soot-removing compositions of this invention are further advantageous in that they permit the economical, rapid and safe removal of accumulated soot deposits from the heating surfaces of oil burner heating systems at lower temperatures than would otherwise be possible. These compositions act as catalysts to lower the ignition temperature of accumulated soot deposits, permitting their rapid and safe removal, in addition to providing a residual soot-removing effect which may last for some time. The processes of this invention may be simply employed, require a minimum of sophisticated equipment, and are easily prepared.

The instant invention satisfies the need for a composition effective in removing accumulated soot deposits and additionally provides a relatively pollutant-free heating oil composition. In particular, the present invention is a distinct improvement over the existing anti-pollutant fuel oil additives and soot-removing compositions in that no toxic or anti-pollutant combustion products are emitted into the atmosphere as a by-product of their use.

The catalytic soot-removing compounds of this invention carry out the anti-pollutant soot-removal functions of existing metallic anti-pollutant agents, but do not have adverse pollutant effects upon the atmosphere as do the existing soot-removal compounds.

In summary, the preferred embodiment of this invention is an anti-pollution heating oil composition containing an organic or inorganic lithium compound soluble in said heating oil to reduce particulate emissions upon combustion of said heating oil. The lithium compounds are effective in operation with as little as 0.165 parts per million by weight of lithium (metal) per unit volume of heating oil.

In addition, the invention provides a plurality of compositions useful for removing accumulated soot deposits by catalytically initiating their combustion at a lower temperature than would otherwise be required for their removal. In this manner, these soot deposits are consumed and converted to heating energy, rather than being emitted into the atmosphere as particulate pollutant agents.

What is claimed is:

1. A chemical composition for removing accumulated soot deposits from the surfaces of a furnace consisting essentially of a lithium salt of a carboxylic acid having from 6 to 18 carbon atoms, an initiator selected from the group consisting of lithium nitrate, potassium nitrate, sodium nitrate, sodium chlorate, sodium perchlorate, potassium chlorate, potassium perchlorate, lithium chlorate and lithium perchlorate.

2. A chemical composition for removing accumulated soot deposits as recited in claim 1, wherein said lithium compound is lithium stearate.

3. A chemical composition for removing accumulated soot deposits as recited in claim 1, wherein said lithium compound is lithium neodecanate.

4. A chemical composition for removing accumulated soot deposits as recited in claim 3 further including a finely divided dry filler material.

5. A chemical composition for removing accumulated soot deposits as recited in claim 4, wherein said filler material is selected from the group consisting of powdered starch, dry sugar, corncob powder and dry dextrines.

6. A chemical composition for removing accumulated soot deposits as recited in claim 5 wherein said composition is in the form of a tablet.

7. The method of removing accumulated soot deposits from the surfaces of a furnace heating installation which comprises applying the composition of claim 1 to said accumulated soot deposits and igniting said composition.

8. A chemical composition useful for catalyzing the ignition of carbonaceous deposits resulting from incomplete combustion of a hydrocarbon heating oil as recited in claim 4, wherein said inert filler comprises wood flour.

* * * * *